US005702857A

United States Patent [19]

Nagai et al.

[11] Patent Number: 5,702,857

[45] Date of Patent: Dec. 30, 1997

[54] METHOD FOR IMPRESSION DEVELOPMENT

[75] Inventors: Takashi Nagai; Nobuyasu Honda; Tomohide Iida; Toshiaki Akiyama; Koji Kuramashi; Asao Toda, all of Osaka, Japan

[73] Assignee: Mita Industrial Co., Ltd., Osaka, Japan

[21] Appl. No.: 808,640

[22] Filed: Feb. 28, 1997

[30] Foreign Application Priority Data

Mar. 5, 1996 [JP] Japan ..... 8-047747
Mar. 5, 1996 [JP] Japan ..... 8-047749

[51] Int. Cl.[6] ..... G03G 13/08

[52] U.S. Cl. ..... 430/101; 430/102; 430/111

[58] Field of Search ..... 430/101, 102

[56] References Cited

U.S. PATENT DOCUMENTS 4,699,865 10/1987 Mitsuhashi ..... 430/101
5,234,786 8/1993 Ueda et al. ..... 430/101
5,620,823 4/1997 Kambayashi et al. ..... 430/102

FOREIGN PATENT DOCUMENTS 1-126665 5/1989 Japan ..... 430/102
7-36277 2/1995 Japan .

*Primary Examiner*—Roland Martin
*Attorney, Agent, or Firm*—Beveridge, DeGrandi, Weilacher & Young, LLP

[57] ABSTRACT

The present invention provides a method for impression development which comprises forming a thin layer of a toner on a surface of a developing roller with a plate-like rigid member, and developing an electrostatic latent image formed on a photoconductor by contacting the thin layer with the electrostatic latent image. The toner comprises toner particles, and prescribed amount of inorganic fine particles (mean particle diameter of 0.1 to 1.0 μm on the volume basis), and/or comprises toner particles which have prescribed distribution of the odd-shape degree of the toner particle (mean value of the odd-shape degree and the proportion of the number of toner particles having the odd-shape degree of not more than 0.2). According to the method for impression development, it becomes possible to form an image having no failures and good image quality.

14 Claims, 1 Drawing Sheet

METHOD FOR IMPRESSION DEVELOPMENT

BACKGROUND OF THE INVENTION

The present invention relates to a method for impression development using a non-magnetic one-component toner as a developer, which is used for image forming devices such as electrostatic copying machine, laser printer device, plain paper facsimile device and the like.

The method for impression development (contact type development) is a method of contacting a developing roller wherein a thin layer of a non-magnetic one-component toner is formed on the surface, with the surface of a photoconductor, and allowing the toner in the thin layer to electrostatically adhere to an electrostatic latent image of the surface of the photoconductor, thereby visualizing (developing) the electrostatic image to form a toner image.

In the above method for impression development, the amount of the toner held on the surface of the developing roller is controlled by using control means made of an elastic member such as rubber, etc., thereby adjusting the thickness of the thin layer formed on the surface of the developing roller.

However, since the elastic member is pressure-contacted with the developing roller by its elasticity, physical properties such as elasticity, hardness, etc. of the elastic member exerts an influence directly on a pressure contacting force of the elastic member to the developing roller, which is an important factor for deciding the thickness of the thin layer, uniformity of the thickness of the thin layer, etc. Therefore, the following problems arise.

(a) When scatter of the above physical properties is caused, in the same elastic member, by ununiformity of the material of the elastic member and an error at the time of producing, scatter of the pressure contacting force also occur and the thickness of the thin layer becomes ununiform in the width direction of the developing roller.

(b) Since physical properties of the elastic member vary with environmental conditions such as temperature, humidity, etc., the pressure contacting force also vary and the thickness of the thin layer is influenced by environmental conditions.

(c) Physical properties of the elastic member varies by deterioration of the elastic member due to use for a long period of time and, therefore, the pressure contacting force varies, which results in variation in thickness of the thin layer with time. As a result, an influence is likely to be exerted on the image quality of the formed image. Also, the yield of the elastic member is likely to be lowered by causing scatter of the pressure contacting force of the elastic member in product, as described in the above term (a).

Therefore, it has recently been suggested that a plate-like rigid member whose surface is smooth (e.g. plate glass, etc.) is used as the above control means in the state where one smooth surface of the rigid member is pressure-contacted with the surface of the developing roller (see JP Laid-Open No. 7-36277).

The rigid member is pressure-contacted with the developing roller by the other member such as spring, etc. and the pressure contacting force in that case is not directly related to physical properties of the rigid member. Besides, the durability of the rigid member is higher than that of the elastic member, and the rigid member withstands use for a long period of time and, therefore, the above-mentioned problems of the elastic member do not arise.

However, when using the above plate-like rigid member as control means in the method for impression development, there arouse the following phenomena.

(d) A stress applied to each toner becomes higher than that in case of using the elastic member, and the toner is liable to fuse to the rigid member.

(e) It becomes extremely easy or extremely difficult to pass through the space between the rigid member and developing roller according to the shape of the toner used. It was also apparent from the study of the present inventors that the phenomena of the above terms (d) and (e) exert a bad influence on the image quality of the formed image.

That is, when the toner fuses to the rigid member as shown in the above term (d), the thin layer of the toner formed on the developing roller becomes thinner at the part where fusing occurs. As a result, the thickness of the thin layer of the toner becomes ununiform and unevenness of the image density occurs. When fusing becomes more severe, it becomes impossible to form the thin layer of the toner at the part and, therefore, traces are likely to be remained as white streak (streak which occurs in the rotative direction of the developing roller or photoconductor, and in the conveying direction of the paper) on the formed image.

Therefore, the present inventors have studied to improve the thermal or mechanical durability of the toner by increasing the molecular weight of the fixing resin constituting the toner or to improve the fluidity of the toner by increasing the amount of the fluidizing agent (e.g. fine particles whose mean particle diameter on the volume basis is about 0.01 μm) to be added to the toner, in order to prevent the toner from fusing to the rigid member.

However, in the former case, fixing properties of the toner to paper becomes insufficient. It was found that, when using the organic photoconductor, so-called "wear of drum" wherein the surface of the photosensitive layer wear by the toner is liable to occur. When the wear amount becomes large, so-called "image fog" wherein the blank space part of the formed image is stained by adhesion of the toner is liable to occur.

In the latter case, it became apparent that a problem such as so-called "filming", wherein the excess fluidizing agent adheres to a charger used for charging or discharging the surface of the photoconductor, and to a surface of the organic photoconductor, occurs.

On the other hand, when using the toner produced by utilizing the suspension polymerization method or dispersion polymerization method as the case shown in the above term (e), such a toner has extremely high fluidity because of nearly spherical shape or similar form and, therefore, it becomes easy for the toner to pass through the space between the rigid member as control means and developing roller. Therefore, the thin layer formed on the developing roller becomes thicker than it needs, wholly, or it partially become thicker and the total thickness becomes ununiform. As a result, the image density becomes too high and unevenness occurs. In addition, so-called "image fog", wherein the blank space part of the formed image is stained by adhesion of the toner, is liable to occur. The toner is not easily charged and is liable to scatter in the combination with the plate glass which is most preferably used as the rigid member, which becomes one factor to cause fog in the formed image.

To the contrary, when using the toner having a shape which is quite different from the spherical form (e.g. needle-like shape, scale-like shape, etc.), it becomes difficult for the toner to pass through the space between the rigid member and developing roller and, therefore, the total thin layer formed on the developing roller becomes thin and the image density is lowered. Alternatively, it becomes impossible to form a thin layer having an uniform thickness on the developing roller and unevenness of the image density occurs. When the thickness of the thin layer becomes small, the stress applied to each toner becomes large and a problem such as fusing of the toner is liable to occur, similar to the above term (d).

SUMMARY OF THE INVENTION

It is a main object of the present invention to provide a method for impression development using a plate-like rigid member as control means, capable of forming an image having no image failures and good image quality.

The first method for impression development of the present invention is characterized by a method for impression development which comprises forming a thin layer of a toner on the surface of a developing roller with a control means for adjusting an amount of the toner held on the surface of the developing roller, and developing an electrostatic latent image formed on a photoconductor by contacting the thin layer with the electrostatic latent image, the control means comprising a plate-like rigid member whose one surface is pressure-contacted with the surface of the developing roller; and the toner comprising toner particles, and inorganic fine particles which have a mean particle diameter of 0.1 to 1.0 μm on the volume basis, and which is added to the toner particles in an amount×(parts by weight) satisfying the following expression (i):

$$0.1 \leqq x < 1.5 \quad \text{(i)}$$

for 100 parts by weight of said toner particles.

According the first method for impression development of the present invention, it becomes possible to certainly prevent a toner from fusing to a rigid member as the control means, thereby forming an image having no image failures and good image quality.

The reason why the mean particle diameter of inorganic fine particles and amount thereof are limited within the above range in the first method for impression development is as follows.

That is, when the mean particle diameter on the volume basis of inorganic fine particles is less than 0.1 μm, or when the amount of inorganic fine particles added based on 100 parts by weight of the toner is less than 0.1 parts by weight, there arises a problem that the polishing effect of inorganic fine particles is insufficient and fusing of the toner to the rigid member can not be prevented.

On the other hand, when the mean particle diameter on the volume basis of inorganic fine particles exceeds 1.0 μm, or when the amount of the inorganic fine particles added based on 100 parts by weight of the toner is not less than 1.5 parts by weight, there arouse a problem that a so-called "wear of drum", wherein the surface of a photosensitive layer wears by the inorganic fine particles specially when using in combination with an organic photoconductor, occurs and fog occurs in the formed image in the case of excessive wear of drum. Furthermore, when the mean particle diameter on the volume basis of inorganic fine particles exceeds 1.0 μm, there also arises a problem that the thin layer of the toner formed on the surface of the developing roller is disordered and, therefore, the formed image is disordered.

The second method for impression development of the present invention is characterized by a method for impression development which comprises forming a thin layer of a toner on the surface of a developing roller with a control means for adjusting an amount of the toner held on the surface of the developing roller, and developing an electrostatic latent image formed on a photoconductor by contacting the thin layer with the electrostatic latent image, the control means comprising a plate-like rigid member whose one surface is pressure-contacted with the surface of the developing roller; and the toner comprising toner particles wherein a mean value of an odd-shape degree determined from a minimum diameter and a maximum diameter of each toner particle by the following equation (ii):

$$\text{odd-shape degree} = (\text{minimum diameter})/(\text{maximum diameter}) \quad \text{(ii)}$$

is within the range from 0.5 to 0.8, and a proportion of the number of toner particles having the odd-shape degree of not more than 0.2 is not more than 20%.

According the second method for impression development of the present invention, it becomes possible to control a thin layer formed on a developing roller to a suitable thickness, thereby forming an image having no image failures and good image quality.

The reason why the mean value of the odd-shape degree of the toner and the proportion of the numbers of toners having the odd-shape degree of not more than 0.2 are limited within the above range in the second method for impression development is as follows.

That is, when the mean value of the odd-shape degree of the toner is less than 0.5, or when the proportion of the toner having the odd-shape degree of not more than 0.2 exceeds 20%, the toner has a shape, which is quite different from the spherical shape, and the proportion of the number of toners, which do not easily pass through the space between the rigid member and developing roller, becomes large. Accordingly, image failures such as the above-mentioned reduction in image density, unevenness, streak, etc. occur.

On the other hand, the mean value of the odd-shape of the toner exceeds 0.8, the toner has a shape, which is almost the same as the spherical shape, and the proportion of the number of toners, which easily pass through the space between the rigid member and developing roller, becomes large. Accordingly, image failures such as the above-mentioned fog occurs in the formed image.

DETAILED DESCRIPTION OF THE INVENTION

Figure 1:
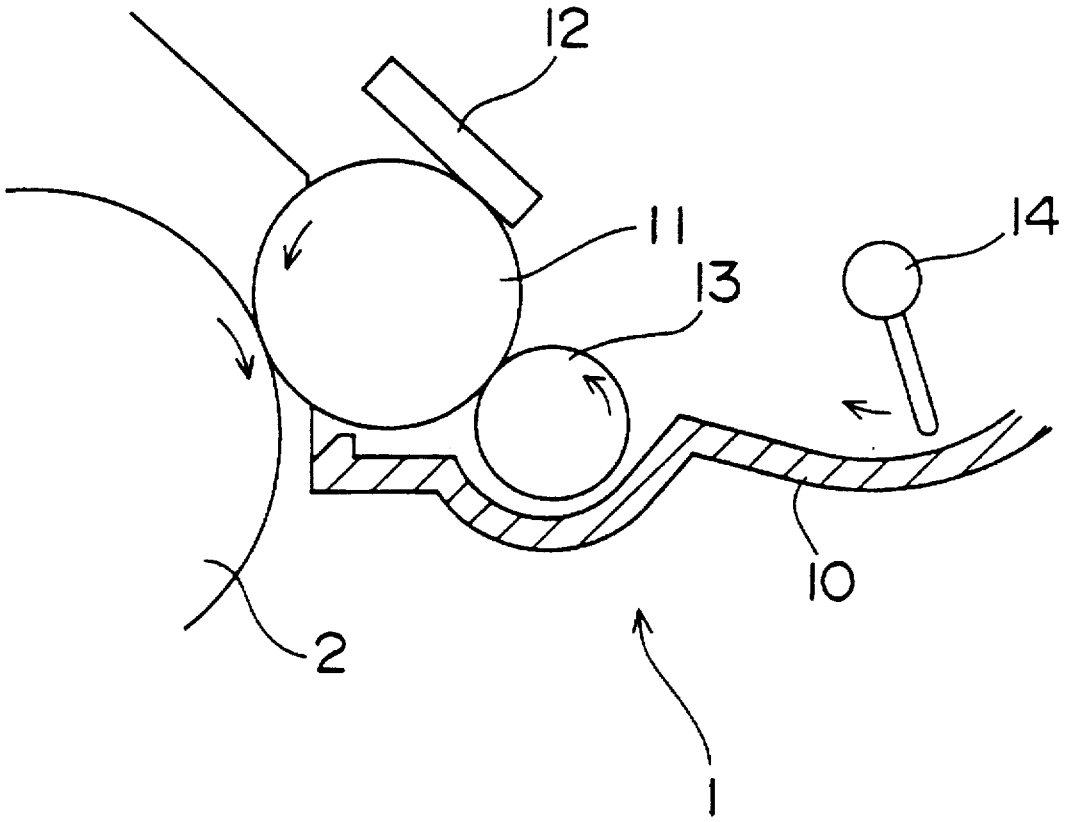
FIG. 1 is a partially cross sectional view illustrating one embodiment of the developing device used in the present invention.

Hereinafter, the present invention will be explained in detail with reference to FIG. 1.

A developing device 1 is equipped with a developing roller 11, a rigid member 12 as control means for forming a thin layer, a toner supplying roller 13 and stirring means 14 arranged behind the toner supplying roller 13, and the respective parts are contained in a device body 10. This developing device body 10 is arranged so that the surface of the developing roller 11 is pressure-contacted with the surface of a photoconductor 2 in an image forming device.

The rigid member 12 has a plate-like shape and one surface thereof is pressure-contacted with the surface of the developing roller 11. The surface of the toner supplying roller 13 is also pressure-contacted with the surface of the developing roller 11.

As the developing roller 11, those wherein at least the surface is made of a flexible urethane rubber etc. are preferably used. The developing roller 11 having the flexible surface is not likely to damage the surface of the photoconductor 2 and has an effect of preventing the above-mentioned image failures (e.g. unevenness of the image density, streak, etc.) caused because the toner easily pass through the space between the rigid member and developing roller, to some extent.

The hardness of the surface of the developing roller 11 is from 45 to 100, preferably 70 to 80, in Asker C. When the hardness of the surface of the developing roller 11 exceeds the above range, there arises a problem that the surface of the photoconductor 2 is liable to be damaged. On the other hand, when the hardness of the surface of the developing roller 11 is smaller than the above range, a durability of the developing roller 11 is lowered. Therefore, the developing roller 11 is liable to be worn, causing a fog in the formed image.

As the rigid member 12 to be pressure-contacted with the above developing roller 11, various plate materials of the rigid material can be used. Among them, a plate glass is preferably used, as described above, in view of smoothness of the surface as a surface to be pressure-contacted with the developing roller 11 or whole rigidity.

It is preferred that the surface of the above rigid member 12 is smooth. Specifically, the surface roughness Ra is not more than 0.2, preferably from 0.001 to 0.1. When the surface roughness Ra of the rigid member 12 exceeds the above range, there arises a problem that the toner is liable to fuse to the rigid member 12.

The rigid member 12 is pressure-contacted with the surface of the developing roller 11 in a predetermined pressure contacting force by pressure contacting means (not shown) (e.g. spring, etc.). Similarly, the developing roller 11 is pressure-contacted with the surface of the photoconductor 2 in a predetermined pressure contacting force by pressure contacting means (not shown) (e.g. spring, etc.).

The pressure contacting force applied when the rigid member 12 is pressure-contacted with the surface of the developing roller 11 is from 4 to 15 g/mm, preferably from 7 to 12 g/mm, in linear pressure. When the pressure contacting force is smaller than the above range, an effect of controlling the amount of the toner held becomes insufficient and it becomes impossible to form the thin layer of the toner on the developing roller 11. On the other hand, when the pressure contacting force exceeds the above range, the surface of the developing roller 11 is likely to be damaged.

Impression development of the static latent image using the above developing device 1 is conducted by the following procedure.

First, the photoconductor 2, developing roller 11, toner supplying roller 13 and stirring means 14 are rotated in the direction of the arrows shown in the figure at a predetermined rotation rate.

Then, the toner (not shown) which is stirred by the stirring means 14 and supplied to the surface of the developing roller 11 by the toner supplying roller 13, is charged by friction with the developing roller 11 and held on the surface of the developing roller 11. The amount of the toner held is controlled by the rigid member 12 as control means and, at the same time, the toner adheres to the surface of the developing roller 11 by an action of an image force of the rigid member 12, thereby forming a thin layer of the toner on the surface of the developing roller 11.

On the other hand, an electrostatic latent image corresponding to the formed image is formed on the surface of the photoconductor 2 through the steps of charging and exposure.

Then, by contacting the electrostatic latent image on the surface of the photoconductor 2 with the thin layer of the toner on the surface of the developing roller 11, the toner in the thin layer electrostatically adhere to the surface of the photoconductor 2 according to distribution of the electric charge in the electrostatic latent image, thereby visualizing the electrostatic latent image to form a toner image. Thus, the steps of impression development has been accomplished.

The method for impression development includes so-called "negative-positive reversal development" wherein a photoconductor and a toner, which are charged to the same polarity each other, are used in combination and the toner is allowed to selectively adhere to the part whose potential was reduced by exposure among the uniformly charged surface of the photoconductor, thereby forming a toner image, and so-called "positive-positive development" wherein a photoconductor and a toner, which are charged to the reverse polarity each other, are used in combination and the toner is allowed to selectively adhere to the part whose potential was not reduced by exposure among the uniformly charged surface of the photoconductor, thereby forming a toner image. The method for impression development of the present invention can be applied to any one of both systems.

The toner used for the method for impression development may be any one of the toner in the above first invention and toner in the above second invention.

As described above, it is necessary that the toner in the first invention may be those prepared by adding inorganic fine particles having a mean particle diameter of 0.1 to 1.0 μm on the volume basis as an additive in an amount ×(parts by weight), based on 100 parts by weight of the toner, which satisfies the following expression (i).

$$0.1 \leqq x < 1.5 \quad \text{(i)}$$

This reason is as described above.

Examples of the above inorganic fine particles include fine particles of magnetite (e.g. iron oxide (III), iron oxide (II), etc.), aluminum oxide, silica, titanium oxide and zinc oxide, but are not limited thereto. Among them, fine particles of magnetite is preferably used because they are superior in polishing effect of the fused toner and cause little wear of drum. The fine particles of magnetite are mainly supplied in the spherical shape or cubic shape. In the present invention, fine particles having any shape may be used alone, or fine particles having the spherical shape and those having the cubic shape may be used in combination.

When the above magnetite fine particles are used as the inorganic fine particle, the mean particle diameter on the volume basis of magnetite fine particles is preferably from about 0.3 to 0.7 μm within the above range, taking the polishing effect of the fused toner and prevention of wear of drum into consideration. The amount of magnetite fine particles added based on 100 parts by weight of the toner is preferably not less than 0.3 parts by weight, more preferably from about 0.5 to 0.7 parts by weight, within the above range, taking coexistence of the above both effects into consideration.

In order to improve the fluidity and charging characteristics of the toner, fine particles whose particle diameter is smaller than that of the above inorganic fine particles as the abrasive by about one order, i.e. fine particles having a primary mean particle diameter on the volume basis of the order of 10 nm may be added as the fluidizing agent as usual.

As the fluidizing agent, there can be used fine powders of metal oxides such as aluminium oxide, silica, titanium oxide, zinc oxide, etc. and various fine particles which have hitherto been known, such as fluororesin fine particles, etc. Particularly, a silica surface treating agent containing hydrophobic or hydrophilic silica fine particles, such as ultrafine silica anhydride, colloidal silica, etc. is preferably used.

The amount of the fluidizing agent added is not specifically limited, and may be the same as that used in a conventional method. Specifically, the fluidizing is preferably added in the total amount from about 0.1 to 3.0 parts by weight based on 100 parts by weight of the toner. Sometimes, the amount may be out of this range.

As the toner in the first invention, i.e. toner wherein the above-mentioned abrasive and fluidizing agent are added, those produced by the grinding method are preferably used as usual. The toner is obtained as follows. First, the colorant and other components are added to the fixing resin, followed by homogeneously premixing with a dry blender, Henschel mixer, ball mill and the like. The resulting mixture is uniformly molten and kneaded, using a kneading device such as Banbury mixer, roll, single- or twin-screw kneading extruder, etc., and then the resulting kneaded product is cooled, ground and optionally classified to obtain a toner.

In this first invention, it is also possible to use a toner having a shape, which is almost the same as the spherical shape, produced by the producing method utilizing a suspension polymerization method, dispersion polymerization method, etc., in addition to the toner obtained by the above grinding method. Since the toner having a shape, which is almost the same as the spherical shape, easily pass through the space between the rigid member as control means and developing roller, it is preferred to use those having an odd-shape obtained by the method described hereinafter in the step after the production of the toner, or in the production process.

As described above, it is necessary that the toner in the second invention may be those wherein a mean value of an odd-shape degree determined from a minimum diameter and a maximum diameter of each toner by the following equation (ii):

$$\text{odd-shape degree}=(\text{minimum diameter})/(\text{maximum diameter}) \quad \text{(ii)}$$

is within the range from 0.5 to 0.8 and a proportion of the number of toners having the odd-shape degree of not more than 0.2 is not more than 20%. This reason is as described above.

The smaller the proportion of the number of toners becomes, the better. It is ideal that the proportion is 0%, that is, the toner having the odd-shape degree of not more than 0.2 is not contained at all. Therefore, the lower limitation of the proportion of the number of toners having the odd-shape degree of not more than 0.2 is not defined.

Among the above numeral value limitation, the mean value of the odd-shape degree of the toner is determined by measuring each minimum diameter and maximum diameter of the predetermined number of toners extracted as the sample, using a microscope etc., calculating the data of the odd-shape degree by the above equation (i), and averaging the data. The proportion of the number of toners having the odd-shape degree of not more than 0.2 is obtained by determining the number of toners having the odd-shape degree of not more than 0.2 from the measuring results of the odd-shape degree in the above predetermined number of toners, and calculating the percentage of them to the total number of measurement. In the Examples described hereinafter, the average of the odd-shape degree of the toner and proportion of the number of toners having the odd-shape degree of not more than 0.2 are determined by setting the number of toners as the sample to 100.

As the toner in the second invention, those produced by the grinding method are preferably used in the same manner as in the toner in the first invention.

In order to adjust distribution of the odd-shape degree of the toner produced by the grinding method, conditions of grinding may be adjusted.

For example, when the molten kneaded product of the above respective components are roughly ground by a feather mill and this crude ground product is pulverized by allowing to collide with a collision plate in the state of being mixed with a jet stream, distribution of the odd-shape degree can be adjusted by adjusting the angle of the collision plate with which the jet stream is allowed to collide.

Specifically, as the angle of the collision plate to the jet stream becomes larger (closer to 90° ), the mean value of the odd-shape degree of the toner is liable to become smaller and the proportion of the number of toners having the odd-shape degree of not more than 0.2 is liable to become larger. On the contrary, as the angle of the collision plate to the jet stream becomes smaller than 90°, the mean value of the odd-shape degree of the toner is liable to become larger and the proportion of the number of toners having the odd-shape degree of not more than 0.2 is liable to become smaller.

It is also possible to increase the mean value of the odd-shape degree of the toner and to decrease the proportion of the number of toners having the odd-shape degree of not more than 0.2 by increasing a channel of the jet stream mixed with the crude ground product or by providing a lot of bend parts in the channel.

It is known that a toner having a nearly spherical shape, produced by the process utilizing a suspension polymerization method, a dispersion polymerization method, etc. can be modified into those having an odd-shape by any means described hereinafter in the step after the production of the toner, or in the production process.

Accordingly, in the second invention, it is possible to use a toner whose distribution of the odd-shape degree of the toner particle after modification (mean value of the odd-shape degree of the toner particle and the proportion of the number of toner particles having the odd-shape degree of not more than 0.2) is within the above range defined in the present invention, even if the toner is produced by the process utilizing a suspension polymerization method, the dispersion polymerization method, etc.

Examples of the method of modifying the toner having the nearly spherical shape, produced by the producing method utilizing a suspension polymerization method, dispersion polymerization method, etc. into a toner having an odd-shape include a method of cohering fine particles to form a toner particle having a particle diameter of a few μm; a method of modifying the toner particle by impregnating water into the toner during polymerization process and then heating it; and the like.

It is preferred that the toner in the first and second inventions has a median size of about 6.0 to 12.0 μm and a mean particle diameter on the volume basis of about 8 to 11 μm. For the purpose of realizing high quality of the formed image, the median size of the toner is preferably not more than 10 μm, but a normal toner having a particle diameter of more than 10 μm may be used.

In the system using a plate glass as the rigid member, a volume resistivity of the toner is preferably not less than $10^8$ Ω.cm, taking charging characteristics into consideration.

Physical properties such as median size and volume resistivity of the above toner can appropriately be changed according to the kind of the system used.

Examples of the fixing resin constituting the toner produced by the above grinding method include styrene resin (homopolymer or copolymer containing styrene or a styrene substitute) such as polystyrene, chloropolystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylate copolymer (e.g. styrene-methyl acrylate copolymer, styrene-ethyl acrylate copolymer, styrene-butyl acrylate copolymer, styrene-octyl acrylate copolymer, styrene-phenyl acrylate copolymer, etc.), styrene-methacrylate copolymer (e.g. styrene-methyl methacrylate copolymer, styrene-ethyl methacrylate copolymer, styrene-butyl methacrylate copolymer, styrene-phenyl methacrylate copolymer, etc.), styrene-α-chloromethyl acrylate copolymer, styrene-acrylonitrile-acrylate copolymer, etc.; poly(vinyl chloride), low-molecular weight polyethylene, low-molecular weight polypropylene, ethylene-ethyl acrylate copolymer, poly (vinyl butyral), ethylene-vinyl acetate copolymer, rosin-modified maleic resin, phenol resin, epoxy resin, polyester resin, ionomer resin, polyurethane resin, silicone resin, ketone resin, xylene resin, polyamide resin and the like. These may be used alone or in combination thereof.

As the colorant, there can be used various dyes, pigments, etc. which have hitherto been known. Among them, carbon black is mainly used in case of a black toner.

As the carbon black, there can be used various carbon blacks which have hitherto been known, such as channel black, roller black, disk black, gas furnace black, oil furnace black, thermal black, acetylene black and the like.

An amount of carbon black added to the fixing resin is not specifically limited. However, since carbon black itself has an electroconductivity, it also serve as means for controlling electric characteristics which exerts an influence on charging properties of the toner. Accordingly, it is preferred to set the preferable range of the amount added according to the desired performances of the toner (particularly, above-mentioned volume resistivity). The amount of carbon black added is not specifically limited, but is preferably from about 1 to 9 parts by weight based on 100 parts by weight of the fixing resin, in view of charging properties of the developer.

Examples of the other component to be added to the fixing resin, together with the colorant, include electric charge controlling material, release agent (anti-offset agent) and various stabilizers.

As the electric charge controlling material, any one of two electric charge controlling materials for controlling a positive charge and a negative charge may be used according to the charged polarity of the toner. In this case, an electric charge controlling material which has a counter charge polarity may be added in a fine amount, in addition to the main electric charge controlling material.

Examples of the electric charge controlling material for controlling a positive charge include organic compounds containing a basic nitrogen atom, such as basic dyes, aminopyridine, pyrimidine compound, polynuclear polyamino compound, aminosilanes, etc., and fillers surface-treated with the above compounds.

Examples of the electric charge controlling material for controlling a negative electric charge include compound containing a carboxyl group (e.g. metal chelate alkyl salicylate, etc.), metal complex salt dyes, fatty acid soap, metal naphthenate, oil-soluble dyes (e.g. nigrosine base (C.I. 5045), oil black (C.I. 26150), bontron S, spiron black, etc.) and electric charge controlling resins (CCR) (e.g. styrene-styrene sulfonate copolymer, etc.).

The electric charge controlling material is added in the amount of 0.1 to 10 parts by weight, preferably 0.5 to 5 parts by weight, based on 100 parts by weight of the fixing resin.

Examples of the release agent (anti-offset agent) include aliphatic hydrocarbons, aliphatic metal salts, higher fatty acids, fatty acid esters or partially saponified material thereof, silicone oil, various waxes and the like. Among them, aliphatic hydrocarbons having a weight-average molecular weight of about 1,000 to 10,000 are preferred. Examples thereof include low-molecular weight polypropylene, low-molecular weight polyethylene, paraffin wax, low-molecular weight olefin polymer of an olefin unit having not less than 4 carbon atoms, and they may be suitably used alone or in combination thereof.

The release agent is added in the amount of 0.1 to 10 parts by weight, preferably 0.5 to 8 parts by weight, based on 100 parts by weight of the fixing resin.

EXAMPLES

The following Reference Examples, Examples and Comparative Examples further illustrate the present invention in detail.

Reference Example 1

<Production of toner>

The following respective components were mixed using a Henschel mixer and, after melting and kneading with a twin-screw kneading extruder, the kneaded product was cooled and then roughly ground with a feather mill. Then, this crude ground product was pulverized by allowing to collide with a collision plate in the state of being mixed with a jet stream. The resulting pulverized product was classified with an air classifying machine to produce a toner having a mean particle diameter on the volume basis of 10.1 μm. An angle of the collision plate to the jet stream at the time of pulverizing the crude ground product was adjusted to 30°.

| (Components) | (Parts by weight) |
|---|---|
| Fixing resin (styrene-acrylic resin) | 100 |
| Colorant (carbon black) | 5 |
| Anti-offset agent (low-molecular weight polypropylene) | 2.5 |
| Electric charge controlling agent (Bontron N-04, commercially available from Orient Kagaku Co., Ltd.) | 5 |

Examples 1 to 5 and Comparative Examples 1 to 2

To 100 parts by weight of the toner produced in Reference Example 1 were added 0.3 parts by weight of silica fine powders (fluidizing agent) having a primary mean particle diameter on the volume basis of 16 nm and magnetite fine particles (abrasive) having a mean particle diameter on the volume basis of 0.3 μm, followed by mixing with Henschel mixer to produce a positive charging type non-magnetic one-component developer. The amount of the magnetite fine particles added based on 100 parts by weight of the toner is 0.1 parts by weight (Example 1), 0.3 parts by weight (Example 2), 0.5 parts by weight (Example 3), 0.7 parts by weight (Example 4), 1.0 parts by weight (Example 5) or 1.5 parts by weight (Comparative Example 2). A developer wherein no magnetite fine particle was added was taken as Comparative Example 1.

(Practical machine test)

Using the developers produced in the above respective Examples and Comparative Examples, continuous image forming (45,000 copies) of a monochrome image was actually conducted by a plain paper facsimile device (Model TC-720, commercially available from Mita Industries Co., Ltd.) of a non-magnetic one-component impression development system, and the number of times of image forming when a streak occurs in the formed image was recorded.

A developing device 1 used for the practical machine test has a structure shown in FIG. 1, wherein a developing roller 11 made of an urethane rubber and a rigid member 12 made of a plate glass are combined. The developing device 1 was used in combination with a positive charging type organic photoconductor 2. A hardness of the surface of the developing roller 11 was 76 in Asker C. A surface roughness Ra of the rigid member 12 was 0.01, and a pressure contacting force of this rigid member 12 to the developing roller 11 was 7.09 g/mm in linear pressure.

The results of the practical machine test are shown in Table 1.

TABLE 1

| | Added amount of magnetite fine particles (Percent by weight) | Number of times of image forming when a streak occurred |
|---|---|---|
| Comparative Example 1 | 0.0 | 1,000 |
| Example 1 | 0.1 | 18,000 |
| Example 2 | 0.3 | 24,500 |
| Example 3 | 0.5 | 33,000 |
| Example 4 | 0.7 | no streak occurred |
| Example 5 | 1.0 | no streak occurred |
| Comparative Example 2 | 1.5 | no streak occurred |

As is apparent from Table 1, in case of using the developer of Comparative Example 1 wherein no magnetite fine particles are added, a streak occurred at a comparatively early stage, e.g. number of times of image forming being 1,000. At this time, the interior of the device was observed. As a result, it was observed that a large amount of the toner fused to the rigid member.

On the other hand, in case of using the developers of Examples 1 to 5 and Comparative Example 2 wherein magnetite fine particles are added, no streak occurred when the number of times of image forming is less than 18,000. Particularly, in case of using the developers of Examples 4 and 5 and Comparative Example 2 wherein the amount of magnetite fine particles added exceeds 0.7 parts by weight, no streak occurred until continuous image forming (45,000 copies) was completed.

After the completion of continuous image forming (45,000 copies), the surface of the photoconductor was observed. As a result, it was found that the amount of wear of the surface of the photoconductor was large in case of using the developers of Example 5 and Comparative Example 2. The amount of wear (decrease in thickness of a photosensitive layer) in case of using the developer of Example 5 was 0.8 μm at most, and was within the practically permissible range of the wear amount (within 1 μm) after 45,000 times of image forming. However, the amount of wear of Comparative Example 2 was 1.3 μm at most, and exceeds the above permissible range. Examples 6 to 10 and Comparative Example 3

To 100 parts by weight of the toner produced in Reference Example 1 were added 0.3 parts by weight of silica fine powders (fluidizing agent) having a primary mean particle diameter on the volume basis of 16 nm and magnetite fine particles (abrasive) having a mean particle diameter on the volume basis of 0.7 μm, followed by mixing with Henschel mixer to produce a positive charging type non-magnetic one-component developer. The amount of the magnetite fine particles added based on 100 parts by weight of the toner is 0.1 parts by weight (Example 6), 0.3 parts by weight (Example 7), 0.5 parts by weight (Example 8), 0.7 parts by weight (Example 9), 1.0 parts by weight (Example 10) or 1.5 parts by weight (Comparative Example 3).

The developers produced in the above respective Examples and Comparative Examples were subjected to the above practical machine test, and their characteristics were evaluated. The results are shown in Table 2.

TABLE 2

| | Added amount of magnetite fine particles (Percent by weight) | Number of times of image forming when a streak occurred |
|---|---|---|
| Example 6 | 0.1 | 19,000 |
| Example 7 | 0.3 | 26,500 |
| Example 8 | 0.5 | 36,500 |
| Example 9 | 0.7 | no streak occurred |
| Example 10 | 1.0 | no streak occurred |
| Comparative Example 3 | 1.5 | no streak occurred |

As is apparent from Table 2, in case of using the developers of Examples 6 to 10 and Comparative Example 3, no streak occurred when the number of times of image forming is less than 19,000. Particularly, in case of using the developers of Examples 9 and 10 and Comparative Example 3 wherein the amount of magnetite fine particles added exceeds 0.7 parts by weight, no streak occurred until continuous image forming (45,000 copies) was completed.

After the completion of continuous image forming (45,000 copies), the surface of the photoconductor was observed. As a result, it was found that the amount of wear of the surface of the photoconductor was large in case of using the developers of Example 10 and Comparative Example 3. The amount of wear (decrease in thickness of a photosensitive layer) in case of using the developer of Example 10 was 0.9 μm at most and was within the above permissible range (within 1 μm) after 45,000 times of image forming. However, the amount of wear of Comparative Example 3 was 1.5 μm at most, and exceeds the above permissible range.

Examples 11 to 13

To 100 parts by weight of the toner produced in Reference Example 1 were added 0.3 parts by weight of silica fine powders (fluidizing agent) having a primary mean particle diameter on the volume basis of 16 nm and aluminium oxide fine particles (abrasive) having a mean particle diameter on the volume basis of 0.5 μm, followed by mixing with Henschel mixer to produce a positive charging type non-magnetic one-component developer. The amount of the aluminium oxide fine particles added based on 100 parts by weight of the toner is 0.1 parts by weight (Example 11), 0.5 parts by weight (Example 12) or 1.0 parts by weight (Example 13).

The developers produced in the above respective Examples were subjected to the above practical machine test, and their characteristics were evaluated. The results are shown in Table 3.

TABLE 3

| | Added amount of aluminium oxide fine particles (Percent by weight) | Number of times of image forming when a streak occurred |
|---|---|---|
| Example 11 | 0.1 | 15,500 |
| Example 12 | 0.5 | 22,000 |
| Example 13 | 1.0 | 38,000 |

As is apparent from Table 3, in case of using the developers of Examples 11 to 13, no streak occurred when the number of times of image forming is less than 15,500.

Examples 14 to 16

To 100 parts by weight of the toner produced in Reference Example 1 were added 0.3 parts by weight of silica fine powders (fluidizing agent) having a primary mean particle diameter on the volume basis of 16 nm and titanium oxide fine particles (abrasive) having a mean particle diameter on the volume basis of 0.4 μm, followed by mixing with Henschel mixer to produce a positive charging type non-magnetic one-component developer. The amount of the titanium oxide fine particles added based on 100 parts by weight of the toner is 0.1 parts by weight (Example 14), 0.5 parts by weight (Example 15) or 1.0 parts by weight (Example 16).

The developers produced in the above respective Examples were subjected to the above practical machine test, and their characteristics were evaluated. The results are shown in Table 4.

TABLE 4

| | Added amount of titanium oxide fine particles (Percent by weight) | Number of times of image forming when a streak occurred |
|---|---|---|
| Example 14 | 0.1 | 14,000 |
| Example 15 | 0.5 | 21,500 |
| Example 16 | 1.0 | 25,500 |

As is apparent from Table 4, in case of using the developers of Examples 14 to 16, no streak occurred when the number of times of image forming is less than 14,000.

Reference Example 2

<Production of toner>

The following respective components were mixed using a Henschel mixer and, after melting and kneading with a twin-screw kneading extruder, the kneaded product was cooled and then roughly ground with a feather mill. Then, this crude ground product was pulverized by allowing to collide with a collision plate in the state of being mixed with a jet stream. The resulting pulverized product was classified with an air classifying machine to produce a toner having a median size of 10.3 μm. An angle of the collision plate to the jet stream at the time of pulverizing the crude ground product was adjusted to 85°.

| (Components) | (Parts by weight) |
|---|---|
| Fixing resin (styrene-acrylic resin) | 100 |
| Colorant (carbon black) | 5 |
| Anti-offset agent (low-molecular weight polypropylene) | 2.5 |
| Electric charge controlling agent (Bontron N-4) | 5 |

After one hundred toners were randomly chosen from the toners produced as described above, a minimum diameter and a maximum diameter of the respective toners of samples were measured using a scale of a microscope and an odd-shape degree was calculated by the above equation (ii). Then, a mean value of the odd-shape degree of one hundred samples and a proportion of the number of toners having the odd-shape degree of not more than 0.2 were determined. As a result, the mean value of the odd-shape degree of the toner was 0.5 and the proportion of the number of toners having the odd-shape degree of not more than 0.2 was 18%.

Example 17

To 100 parts by weight of the toner produced in Reference Example 2 was added 0.5% by weight of silica fine powders having a primary average particle diameter on the volume basis of 16 nm, followed by mixing with Henschel mixer to produce a positive charging type non-magnetic one-component developer.

Example 18

According to the same manner as that described in Reference Example 2 except for adjusting the angle of the collision plate to the jet stream at the time of pulverizing the crude ground product to 70°, a toner having a median size of 10.4 μm was produced.

According to the same manner as that described in Reference Example 2, the mean value of the odd-shape degree of this toner and proportion of the number of toners having the odd-shape degree of not more than 0.2 were determined. As a result, the mean value of the odd-shape degree of the toner was 0.8 and the proportion of the number of toners having the odd-shape degree of not more than 0.2 was 15%.

According to the same manner as that described in Example 17 except for using the above toner in place of the toner produced in Reference Example 2, a positive charging type non-magnetic one-component developer was produced.

Comparative Example 4

According to the same manner as that described in Reference Example 2 except for adjusting the angle of the collision plate to the jet stream at the time of pulverizing the crude ground product to 90°, a toner having a median size of 10.5 μm was produced.

According to the same manner as that described in Reference Example 2, the mean value of the odd-shape degree of this toner and proportion of the number of toners having the odd-shape degree of not more than 0.2 were determined. As a result, the mean value of the odd-shape degree of the toner was 0.5 and the proportion of the number of toners having the odd-shape degree of not more than 0.2 was 25%.

According to the same manner as that described in Example 17 except for using the above toner in place of the toner produced in Reference Example 2, a positive charging type non-magnetic one-component developer was produced.

Comparative Example 5

The following respective components were stirred at 5,000 r.p.m. with a high-speed stirrer for 5 minutes to prepare a monomer phase mixed solution for suspension polymerization.

| (Components) | (Parts by weight) |
|---|---|
| Polymerizable resin | |
| Styrene | 82 |
| n-Butyl methacrylate | 18 |
| Colorant (carbon black) | 5 |
| Electric charge controlling agent (Bontron N-01 commercially available from Orient Kagaku Co., Ltd.) | 5 |
| Polymerization initiator (2,2'-azobisisobutyronitrile) | 3 |
| Crosslinking agent (diethylene glycol dimethacrylate) | 2 |

Then, the above monomer phase mixed solution was mixed with an aqueous dispersing medium comprising the following respective components, followed by stirring at 10,000 r.p.m. with the aforecited high-speed stirrer for 10 minutes to prepare a suspension wherein a mean particle diameter of droplets is 10.5 μm.

| (Components) | (Parts by weight) |
|---|---|
| Ion-exchanged water | 800 |
| Dispersion stabilizer (poly(vinyl alcohol)) | 2 |

Then, the above suspension was transferred to a 3 liter separable flask equipped with a stirrer, a nitrogen introducing tube and a condenser, wherein the interior is substituted with nitrogen gas, and polymerized by heating to 80° C. with stirring at 120 r.p.m. for 5 hours, followed by cooling to room temperature.

Then, a nearly spherical toner having a median size of 10.5 μm was produced through the steps of filtration, washing with ion-exchanged water and drying.

According to the same manner as that described in Reference Example 2, the mean value of the odd-shape degree of this toner and proportion of the number of toners having the odd-shape degree of not more than 0.2 were determined. As a result, the mean value of the odd-shape degree of the toner was 0.9 and the proportion of the number of toners having the odd-shape degree of not more than 0.2 was 0%.

According to the same manner as that described in Example 17 except for using the above toner in place of the toner produced in Reference Example 2, a positive charging type non-magnetic one-component developer was produced.

(Thin layer forming test)

Using the developers produced in Examples 17 and 18, and Comparative Examples 4 and 5, a thin layer of the toner was formed on the surface of the developing roller by the plain paper facsimile device of a non-magnetic one-component impression development system (aforecited). As the developing device 1 used for forming the thin layer, the same one as that used in the above practical machine test (see FIG. 1), and this was used in combination with the positive charging type organic photoconductor 2.

Then, a thickness (μm) of the thin layer was measured at five points in the width direction of the developing roller 11. As the measuring points (points A to E) were selected from one end side (driving side) connected with a driving gear to the other end side (driven side) of the developing roller 11. The results are shown in Table 5, together with the mean value of the odd-shape degree of the toner ($A_{DF}$) and proportion of the number of toners having the odd-shape degree of not more than 0.2 ($DF_{0.2}$ (%)) in the toners of the respective Examples and Comparative Examples.

TABLE 5

| Odd-shape degree | | Comparative Example 4 | Example 17 | Example 18 | Comparative Example 5 |
|---|---|---|---|---|---|
| | $A_{DF}$ | 0.5 | 0.5 | 0.8 | 0.9 |
| | $DF_{0.2}$ | 25% | 18% | 15% | 0% |
| Thickness of thin layer (μm) | Point A | 12.5 | 21.2 | 27.5 | 32.5 |
| | Point B | 9.8 | 23.5 | 28.3 | 35.0 |
| | Point C | 5.8 | 22.7 | 29.0 | 41.3 |
| | Point D | 10.2 | 23.0 | 28.5 | 40.8 |
| | Point E | 7.5 | 21.8 | 27.8 | 38.2 |

As is apparent from Table 5, it was found that, in case of using the developer of Comparative Example 4 wherein the proportion of the number of toners having the odd-shape degree of not more than 0.2 ($DF_{0.2}$ (%)) exceeds 20%, the thin layer of the toner formed on the surface of the developing sleeve is wholly thin and distribution of the thickness is ununiform. The thin layer was visually observed. As a result, the thin layer was uneven and the part where no thin layer was formed at all was observed. Furthermore, a trial of continuous image forming of a monochrome image was actually conducted by using the developer of Comparative Example 4 for the above plain paper facsimile device. As a result, the formed image was became blurred at the initial stage of image forming and, therefore, image forming was compelled to give up.

As is apparent from Table 5, it was found that, in case of using the developer of Comparative Example 5 wherein the mean value of the odd-shape degree of the toner ($A_{DF}$) exceeds 0.8, the thin layer of the toner formed on the surface of the developing sleeve is wholly thick and distribution of the thickness is ununiform. The thin layer was visually observed. As a result, it was observed that a thin layer is further adhered to the thin layer so that the thin layer is disarranged. Furthermore, continuous image forming of a monochrome image was actually conducted by using the developer of Comparative Example 5 for the above plain paper facsimile device. As a result, fog occurred at the blank space part of the formed image at the initial stage of image forming. Therefore, a density of this fog was measured using a reflection densitometer (Model TC-6D, manufactured by Tokyo Denshoku Co., Ltd.). As a result, it was 0.020. It was found that the density largely exceed 0.08 which is within the practically permissible range of the fog density.

To the contrary, as is apparent from Table 5, it was found that, in the case of using the developers of Examples 17 and 18, the thickness of the thin layer of the toner formed on the surface of the developing sleeve is in the level of 20 μm, which is suitable for image forming by the above plain paper facsimile device, and distribution of the thickness is almost uniform. The above thin layer was visually observed. As a result, it was confirmed that the thin layer is not uneven and disarranged and, therefore, it is almost uniform. Furthermore, continuous image forming of a monochrome image was actually conducted by using the developers of Comparative Examples 17 and 18 for the above plain paper facsimile device. As a result, a good image was formed without causing fog, blur, streak, etc. from the initial stage of image forming to the completion of continuous image forming (45,000 copies).

Example 19

To 100 parts by weight of the toner produced in Reference Example 2 were added 0.5% by weight of silica fine powders (fluidizing agent) having a primary mean particle diameter on the volume basis of 16 nm and 0.7 parts by weight of magnetite fine particles (abrasive) having a primary mean particle diameter on the volume basis of 0.3 mm, followed by mixing with Henschel mixer to produce a positive charging type non-magnetic one-component developer.

According to the same manner as that described in the above practical machine test, continuous image forming of a monochrome image (30,000 copies) was conducted using the above developer.

As a result, streak did not occur at all until continuous image forming (30,000 copies) was completed. An uniform thin layer formation was maintained.

What is claimed is:

1. A method for impression development which comprises forming a thin layer of a toner on the surface of a developing roller with a control means for adjusting an amount of the toner held on the surface of the developing roller, and developing an electrostatic latent image formed on a photoconductor by contacting the thin layer with the electrostatic latent image, said control means comprising a plate-like rigid member whose one surface is pressure-contacted with the surface of the developing roller; and said toner comprising toner particles, and inorganic fine particles which have a mean particle diameter of 0.1 to 1.0 μm on the volume basis, and which is added to the toner particles in an amount×(parts by weight) satisfying the following expression (i):

$$0.1 \leqq x < 1.5 \quad \text{(i)}$$

for 100 parts by weight of said toner particles.

2. A method for impression development according to claim 1, wherein the inorganic fine particles comprise at least one selected from the group consisting of magnetite, aluminium oxide, silica, titanium oxide and zinc oxide.

3. A method for impression development according to claim 2, wherein the inorganic fine particles comprise magnetite.

4. A method for impression development according to claim 3, wherein the mean particle diameter on the volume basis of magnetite is from 0.3 to 0.7 μm, and the amount of magnetite added based on 100 parts by weight of the toner particles is from 0.3 to 1.5 parts by weight.

5. A method for impression development according to claim 1, wherein a median size of the toner is from 6.0 to 12.0 μm.

6. A method for impression development according to claim 1, wherein a surface roughness Ra of the rigid member pressure-contacted with the developing roller is not more than 0.2 μm.

7. A method for impression development according to claim 1, wherein a pressure contacting force of the rigid member to the developing roller is from 4 to 15 g/mm in linear pressure.

8. A method for impression development according to claim 1, wherein a hardness of the surface of the developing roller is from 45 to 100 in Asker C.

9. A method for impression development which comprises forming a thin layer of a toner on the surface of a developing roller with a control means for adjusting an amount of the toner held on the surface of the developing roller, and developing an electrostatic latent image formed on a photoconductor by contacting the thin layer with the electrostatic latent image, said control means comprising a plate-like rigid member whose one surface is pressure-contacted with the surface of the developing roller; and said toner comprising toner particles wherein a mean value of an odd-shape degree determined from a minimum diameter and a maximum diameter of each toner particle by the following equation (ii):

$$\text{odd-shape degree} = (\text{minimum diameter})/(\text{maximum diameter}) \quad \text{(ii)}$$

is within the range from 0.5 to 0.8, and a proportion of the number of toner particles having the odd-shape degree of not more than 0.2 is not more than 20%.

10. A method for impression development according to claim 9, wherein a median size of the toner is from 6.0 to 12.0 μm.

11. A method for impression development according to claim 9, wherein a surface roughness Ra of the rigid member pressure-contacted with the developing roller is not more than 0.2 μm.

12. A method for impression development according to claim 9, wherein a pressure contacting force of the rigid member to the developing roller is from 4 to 15 g/mm in linear pressure.

13. A method for impression development according to claim 9, wherein a hardness of the surface of the developing roller is from 45 to 100 in Asker C.

14. A method for impression development which comprises forming a thin layer of a toner on the surface of a developing roller with a control means for adjusting an amount of the toner held on the surface of the developing roller, and developing an electrostatic latent image formed on a photoconductor by contacting the thin layer with the electrostatic latent image, said control means comprising a plate-like rigid member whose one surface is pressure-contacted with the surface of the developing roller; and said toner comprising toner particles, and inorganic fine particles which have a mean particle diameter of 0.1 to 1.0 μm on the volume basis, and which is added to the toner particles in an amount×(parts by weight) satisfying the following expression (i):

$$0.1 \leqq x < 1.5 \quad \text{(i)}$$

for 100 parts by weight of said toner particles, wherein a mean value of an odd-shape degree determined from a minimum diameter and a maximum diameter of each toner particle by the following equation (ii):

$$\text{odd-shape degree} = (\text{minimum diameter})/(\text{maximum diameter}) \quad \text{(ii)}$$

is within the range from 0.5 to 0.8, and a proportion of the number of toner particles having the odd-shape degree of not more than 0.2 is not more than 20%.

* * * * *